US009279288B2

(12) United States Patent
Duff

(10) Patent No.: US 9,279,288 B2
(45) Date of Patent: Mar. 8, 2016

(54) STEPLESS LADDER ASSEMBLY AND METHODS OF UTILIZING SAME

(71) Applicant: Thomas G. Duff, Brielle, NJ (US)

(72) Inventor: Thomas G. Duff, Brielle, NJ (US)

( * ) Notice: Subject to any disclaimer, the term of this patent is extended or adjusted under 35 U.S.C. 154(b) by 0 days.

(21) Appl. No.: 14/133,633

(22) Filed: Dec. 18, 2013

(65) Prior Publication Data

US 2014/0166399 A1 Jun. 19, 2014

Related U.S. Application Data

(60) Provisional application No. 61/739,099, filed on Dec. 19, 2012.

(51) Int. Cl.
*A63B 27/00* (2006.01)
*E06C 1/393* (2006.01)

(52) U.S. Cl.
CPC *E06C 1/393* (2013.01); *A63B 27/00* (2013.01)

(58) Field of Classification Search
CPC ..... A63B 27/00; A63B 27/02; E06C 7/16
USPC ..... 182/146, 141, 103
See application file for complete search history.

(56) References Cited

U.S. PATENT DOCUMENTS

| | | | | | |
|---|---|---|---|---|---|
| 2,796,299 | A * | 6/1957 | Freeman | 52/111 |
| 2,800,371 | A * | 7/1957 | Quercetti | 182/103 |
| 3,075,611 | A * | 1/1963 | Baringer | 182/134 |
| 3,126,071 | A * | 3/1964 | Basset | 472/2 |
| 3,548,970 | A * | 12/1970 | Hutchens, Sr. | 182/129 |
| 3,946,836 | A * | 3/1976 | Maack | 187/239 |
| 4,353,544 | A * | 10/1982 | Wiley | 482/59 |
| 4,512,440 | A * | 4/1985 | Bixby | 182/146 |
| 5,145,031 | A * | 9/1992 | Sprunger | 182/141 |
| 5,487,446 | A * | 1/1996 | Patnode et al. | 182/148 |
| 7,004,288 | B2 * | 2/2006 | Araki et al. | 182/103 |
| 7,370,725 | B1 * | 5/2008 | Dornfeld | 182/2.2 |
| 7,909,139 | B2 * | 3/2011 | Blue et al. | 182/141 |
| 2009/0183949 | A1 * | 7/2009 | Baranovskis et al. | 182/204 |
| 2011/0265679 | A1 * | 11/2011 | Smith et al. | 104/53 |

* cited by examiner

*Primary Examiner* — Alvin Chin-Shue
(74) *Attorney, Agent, or Firm* — Michael P. Kochka, Esq.

(57) ABSTRACT

A stepless ladder is provided that may comprise a frame adapted to support the weight of a user, a track attached to a portion of the frame, an escalating member attached to the track, the escalating member for supporting the weight of the user, and an escalating means adapted to raise and lower the escalating member along the track.

19 Claims, 8 Drawing Sheets

STEPLESS LADDER ASSEMBLY AND METHODS OF UTILIZING SAME

CROSS-REFERENCE TO RELATED APPLICATIONS

The present application claims priority to U.S. Provisional Patent Application Ser. No. 61/739,099 entitled "Stepless Ladder Assembly and Methods of Utilizing Same," filed Dec. 19, 2012, the disclosure of which is incorporated herein by reference in its entirety.

BACKGROUND

1. Field of the Invention

Embodiments of the present invention are generally related to a stepless ladder and methods of utilizing the same. More specifically, embodiments of the present invention relate to a ladder having no traditional steps thereon, providing a more stable means of going up and down the ladder.

2. Description of Related Art

The use of a conventional step ladder involves the coordinated application of multiple major motor skills for any user. That basic fact, combined with the height involved, the typical need to transport tools and work supplies creates a risk hazard whenever it is used, even in an otherwise normal working environment. The small standing surface afforded by such a conventional ladder adds to the difficulty in working safely.

When individuals have less than excellent agility and balance or are unaccustomed to working on a ladder, attempting to use a ladder can be prescription for disaster. For example, older persons or persons with some degree of physical impairment may put themselves at a high degree of risk of falling off the ladder and becoming seriously injured. Progressing up each step is a difficult task to undertake for those with less than excellent athletic ability. In addition, as a user progresses up the steps of a traditional ladder, the user must shift his or her weight back and forth from foot to foot, exerting unequal lateral weight distribution on each side of the ladder. As the lateral weight distribution is skewed toward one side of the ladder, the ladder becomes more unstable and more susceptible to losing contact with the ground. When the ladder becomes unstable, a higher risk of the ladder tipping or the user losing his or her balance and falling off is created. As such, there is a need for a more stable ladder that does not require back and forth lateral weight shifting or stepping up traditional ladder steps.

As such, there is a need for a stepless ladder assembly and methods of utilizing the same.

SUMMARY

Embodiments of the present invention are generally related to a stepless ladder assembly that may comprise a frame adapted to support the weight of a user, a track attached to a portion of the frame, an escalating member attached to the track, the escalating member for supporting the weight of the user, and an escalating means adapted to raise and lower the escalating member along the track.

In another embodiment of the present disclosure, a stepless ladder assembly may comprise a frame adapted to support the weight of a user, a track attached to a portion of the frame, an escalating member attached to the track, the escalating member for supporting the weight of the user, an escalating means adapted to raise and lower the escalating member along the track, the escalating means comprising, a first locking disc comprising an edge and a recessed portion, a handle attached to the first locking disc, a second locking disc comprising an edge and a recessed portion, a link member connected to the second locking disc and the handle, a first pin attached to the track, the pin adapted to support the first locking disc, and a second pin attached to the track, the second pin adapted to support the second locking disc, wherein when the handle is pulled upwardly, the first locking disc becomes disengaged from the first pin and the first locking disc may be raised up and engaged with a higher pin.

In yet another embodiment of the present invention, a method of using a stepless ladder assembly may comprise providing a ladder assembly comprising: a frame adapted to support the weight of a user, a track attached to a portion of the frame, an escalating member attached to the track, the escalating member for supporting the weight of the user, an escalating means adapted to raise and lower the escalating member along the track; activating the escalating means to raise the escalating member upwardly along the track, thereby raising the user; and activating the escalating means to lower the escalating member downwardly along the track, thereby lowering the user.

BRIEF DESCRIPTION OF THE DRAWINGS

So the manner in which the above-recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
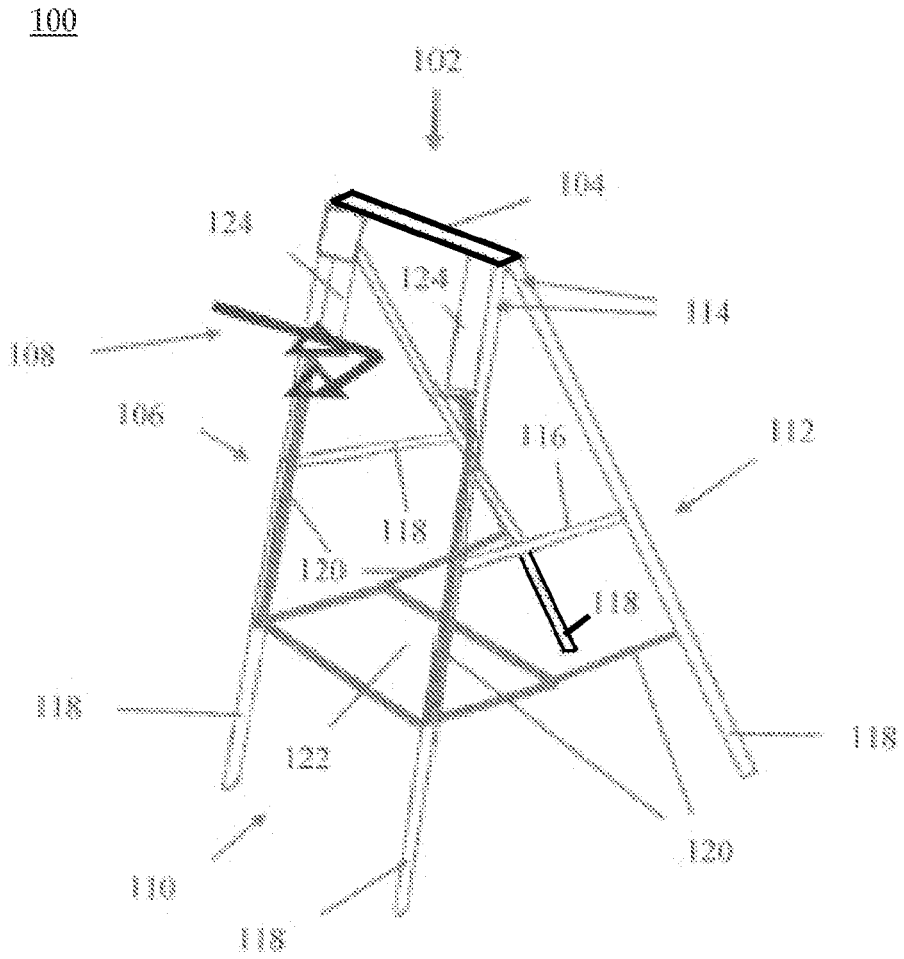
FIG. 1 depicts a perspective view of a stepless ladder assembly in accordance with embodiments of the present invention.
Figure 2A:
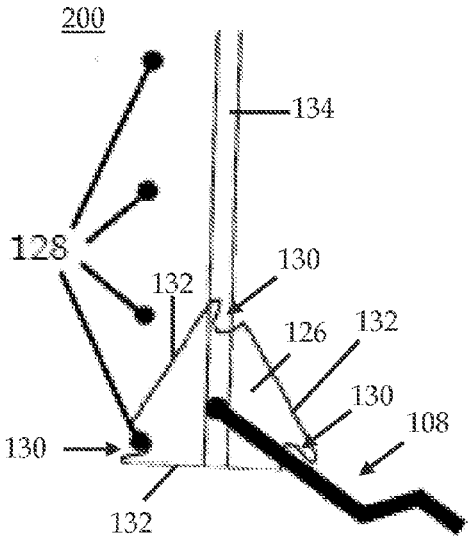
FIGS. 2A-2D depict a view of the positioning of a locking disc in an escalating position for use with a stepless ladder in accordance with embodiments of the present invention.
Figure 2B:
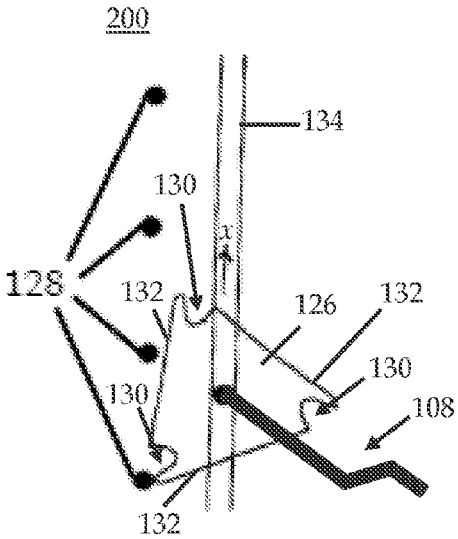
Figure 2C:
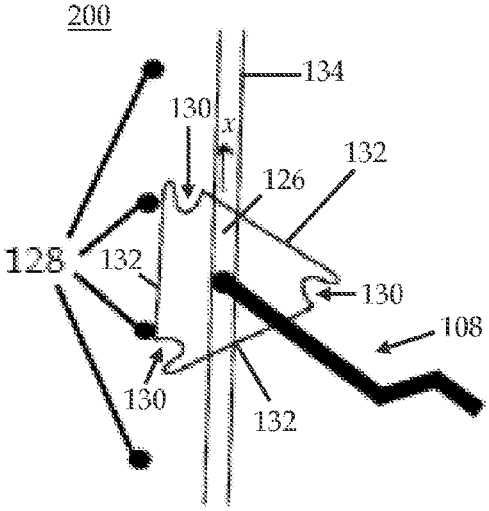
Figure 2D:
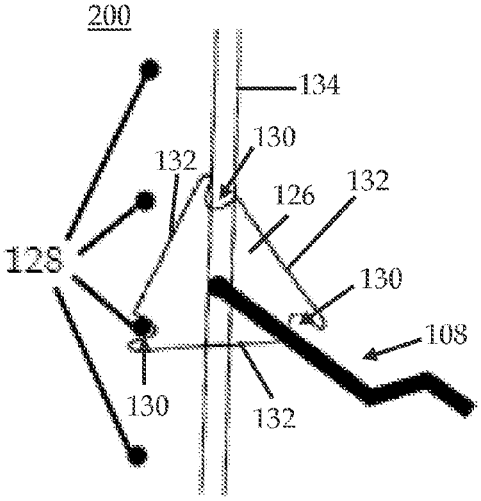
Figure 3A:
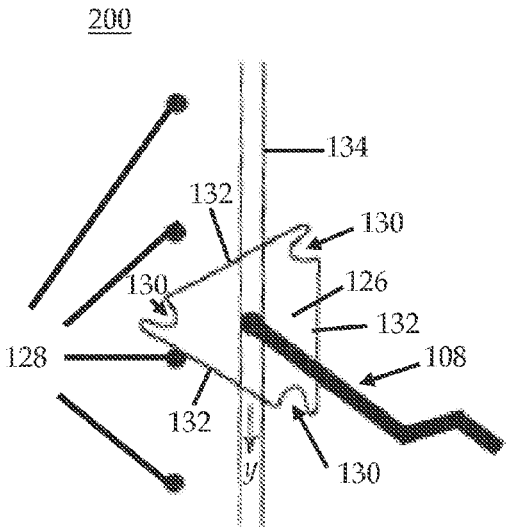
FIG. 3A-3D depicts a view of the positioning of a locking disc in an descending position for use with the embodiments of the stepless ladder shown in FIG. 2.
Figure 3B:
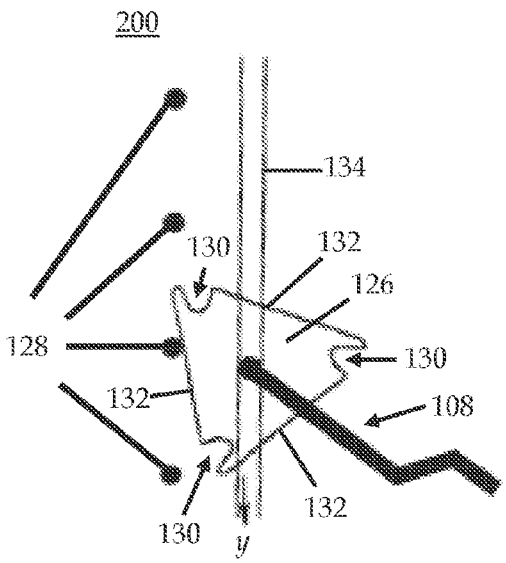
Figure 3C:
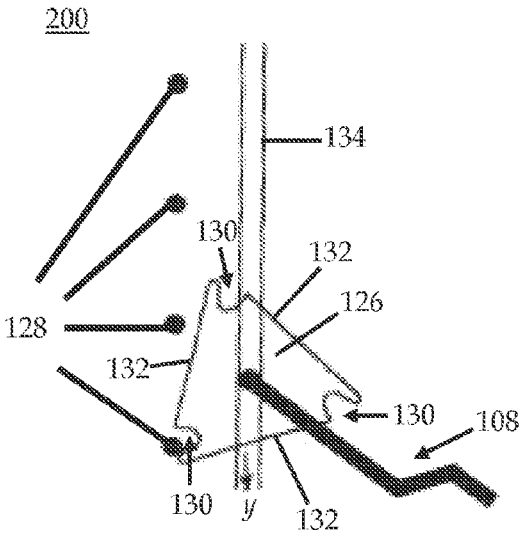
Figure 3D:
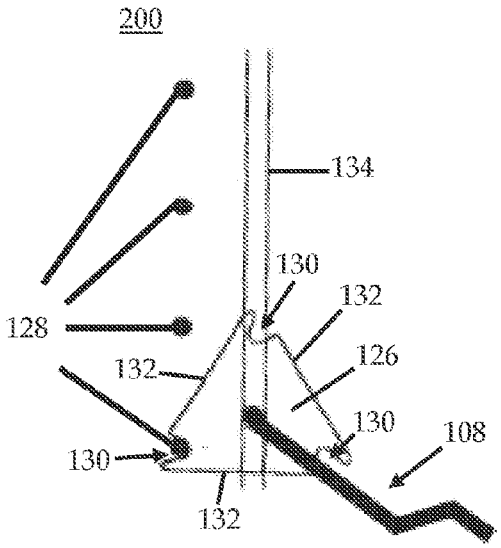

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention are generally related to a stepless ladder and methods of utilizing the same. More specifically, embodiments of the present invention relate to a ladder having no traditional steps thereon, providing a more stable means of going up and down the ladder.

FIG. 1 depicts a perspective view of a stepless ladder assembly 100 in accordance with exemplary embodiments of the present invention. A stepless ladder generally comprises a frame 102, a top shelf 104 across the top of the frame 102, an escalating member 106, and an escalating means 108 for raising and lowering the escalating member 106 within the frame.

The frame 102 may comprise any type of frame 102 suitable for embodiments of the present invention. The frame 102 may comprise a material adapted to support the weight of at least one user. For example, the frame 102 may comprise metal. In one embodiment, the frame 102 may be collapsible, for example, as is ordinarily found with most step ladders. In exemplary embodiments, the frame 102 may generally comprise a front portion 110 having the escalating means 108 and escalating member 106 thereon, and a rear portion 112 for balancing the ladder. In some embodiments, a stepless ladder 100 may comprise more than one escalating means 108 and/or escalating member 106. For example, a stepless ladder 100 may comprise two, three, four, or the like escalating means 108 and/or escalating members 106. In some embodiments, when the ladder 100 comprises more than one escalating means 108 and/or escalating member 106, the second escalating means and/or escalating member (not shown) may be disposed on or near the rear portion 112 of the stepless ladder 100.

The front portion 110 and rear portion 112 may be connected on respective top ends 114 at the top shelf 104. In some embodiments, the top shelf 104 may be adapted to form as a stopping mechanism for the escalating member 106, and/or may be adapted to support items. For example, the top shelf 104 may be adapted to support one or more tools (not shown) for the user. In addition, the front and rear portion 112 may be connected via a bar/rod 116 positioned midway up the front portion 110 and the rear portion 112, on one or both sides of the frame 102. In some embodiments, the bar 116 may be foldable via a hinge, thereby allowing the stepless ladder 100 to collapse and/or be collapsed. The top shelf 104 may generally comprise any shaped structure forming the top of the ladder 100 and engaging at least the front portion 110. In some embodiments, the rear portion 112 is also connected to the top shelf 104, optionally in a rotatable manner. In some embodiments, the top shelf 104 may comprise an extended platform adapted to support the weight of multiple items, such as tools.

In alternative embodiments, the frame 102 may comprise a single portion structure (e.g., like the front portion 110) whereby the frame 102 may lean against another structure. In further embodiments, any type of generally known ladder structure may be suitable for the frame. Although a ladder with an A-frame is depicted in the figures, the stepless ladder 100 may comprise a shape adapted to support the weight of a user and receive the escalating member 106. The ladder 100 may be adapted to be supported by one or more legs 118. Although four legs 118 are depicted in the Figures, any number of legs adapted to support the weight of user while standing on the escalating member 106 is contemplated by and within the present disclosure. For example, the ladder 100 may comprise two, three, four, five, six legs 118, or the like.

An escalating member 106 may comprise any shape or structure suitable for stably supporting a user thereon during operation of the stepless ladder 100. In some embodiments, the escalating member 106 may include a chair, a seat, an apparatus adapted to allow a user to sit down, or the like. The escalating member 106 may comprise a platform 122 adapted to support the weight of a user, and one or more attachment arms 120 for attaching the escalating member 106 to the escalating means 108 and/or the ladder 100. In some embodiments, the platform 122 may comprise a flat surface attached to the escalating means 108 with one or more attachment arms 120, one at each corner. In exemplary embodiments, the escalating member 106 may comprise four attachment arms 120. In one embodiment, the escalating member 106 may be substantially in the shape of a traditional step or stair. In an alternative embodiment, the escalating member 106 may comprise a bucket or similar encasing-type apparatus in which a user may stand. In yet another embodiment, the escalating member 106 may comprise a set of single-foot platforms, such that one of each of the user's feet may be placed on a separate platform. In each embodiment, the escalating member 106 may comprise safety straps, belts, or other safety mechanisms to ensure the user does not fall off the escalating member.

In many embodiments, the escalating member 106 is generally affixed to the escalating means 108 via one or more attachment arms 120. As shown in FIG. 1, an attachment arm 120 may comprise a set of rods and/or posts that extend from the escalating member 106, for example, at the corners of the escalating member 106. The arms 120 may comprise a single piece or multiple pieces, and may be hinged and/or telescoping. In some embodiments, the arms 120 may comprise hydraulics. In other embodiments, the attachment arm 120 may comprise any structure for affixing the escalating member 106 to the escalating means 108, such as, for example, a strap, rope, beam, chain, or the like.

The escalating means 108 may generally comprise any means suitable to enable a user to activate the escalating means 108 and lift the user with the escalating member 106. In the embodiment shown, the escalating means 108 comprises a hand-crank and/or lever device in connection with a plurality of locking discs (e.g., cams) as described below. A locking disc may generally be free to rotate about a central axle, and/or the like passing through and/or into the locking disc. In such an embodiment, the escalating means 108 may further comprise a track positioned within the front portion 110 of the frame 102 having pins for engaging the locking discs. A portion of the escalating means 108, for example, the track, the pins, and the locking discs, or the like, may be positioned behind safety guards 124. The operation of the escalating means 108 will be described in more detail below. In some embodiments, the height of the escalating member 106 off the ground may be indicated by a height indicator (not shown). A height indicator may comprise a mechanical or digital indicator adapted to be coupled with the escalating member 106 and/or the escalating means 108 to indicate the height the escalating member 106 is off the ground. The height may be displayed in a measurement, such as inches, centimeters, or feet, or may be displayed in levels, for example, level one, level two, level three, or the like. In some embodiments, the height indicator may be disposed on the ladder 100. A stepless ladder 100 may comprise an escalating means and an escalating member adapted to substantially mimic the action of a human as they climb a conventional ladder, using their legs to progressively ascend each step.

Referring now to FIGS. 2A-5E, although generally depicted in the figures as part of a ladder assembly, a lifting mechanism 200, 300, may be used independently in different applications. A lifting mechanism 200, 300, for example, may be used to lift and/or lower objects, people, or things in the fields of medicine, construction, toys, and/or the like. In some embodiments, the lifting mechanism 300 may be used in marine applications, such as underwater scaffolds and/or the like. In some embodiments, the lifting mechanism 200, 300 may be included as part of a toy for children. In some embodiments, the lifting mechanism 200, 300 may be used in industrial or manufacturing applications. The lifting mechanisms 200, 300 are generally described with respect to FIGS. 2A-5E, and may be used in applications for lifting and/or lowering objects consistent with the present disclosure. In some embodiments, the lifting mechanism 200, 300 may be sold apart from another device, such as a ladder, or the like. The lifting mechanism 200, 300 may be manufactured in any size consistent with the present disclosure. For example, in the case of an example toy, the lifting mechanism 200, 300 may comprise less than 11 inches of height and/or width, or the like. As another example, in large industrial applications, where relatively heavy objects must be lifted, the length and/or width of the lifting mechanism may be more than 6 feet. In some embodiments, a mechanical and/or electrical/mechanical device may be used to actuate the escalating means, the lever, and/or the like.

FIGS. 2A-2D depict a set of views of the positioning of a locking disc 126 in an escalating position, in the direction of arrow x, for use with a stepless ladder 100 in accordance with embodiments of the present invention. Although the escalating means 108 is depicted in the Figures as being directly attached to the locking disc 126, in other exemplary embodiments the escalating means 108 may be indirectly attached and/or connected to the locking disc 126. For example, the escalating means 108 may be connected to the locking disc 126 through pulleys, gears, and/or the like. In some embodiments, the escalating means 108 may comprise a hand crank and/or lever. In alternative embodiments, the escalating means 108 may comprise an electrical and/or mechanical means adapted to raise and/or lower the escalating member 108. For example, the escalating means 108 may comprise a string or a chain coupled with a pulley, an electronic actuator powered by a power source and activated by a button or a switch, and/or the like. The locking discs 126 may comprise edges 132 and recessed portions 130. The recessed portions 130 may be adapted to receive a pin 128. The pin 128 may be attached to the ladder 100 or may be attached to another member or support attached to the ladder. In exemplary embodiments, the pins 128 may be immovably attached to the ladder 100. In some embodiments, the pins 128 may be connected to a track 134 connected to and/or integral with the ladder 100. In some embodiments, the pins 128 may be attached to a track 134 adapted to move up and down via electrical and/or mechanical means and thereby move the pins 128 and/or locking disc 126 up and down the track 134. Although the locking disc 126 is depicted in a triangular shape in the Figures, any shape adapted to move an escalating member 106 in accordance with the present invention is contemplated.

In operation, a user may stand or otherwise be supported on the escalating member 106 and the escalating means 108 may be activated. The escalating means 108 may move the escalating member 106 up and/or down the ladder 100. The engagement of a pin 128 into a notch 130 is automatic after activation of the escalating means 108. The escalating means 108 may be activated by a ratcheting motion up or down, or the like. In some embodiments, the escalating means 108 may be adapted to move and/or lock the escalating member 106 into any position along the height of the ladder 100 along the track 134. In alternative embodiments, the escalating means 108 may be adapted to move the escalating member 106 to predetermined fixed positions, for example, every 6 inches, every foot, every two feet, or the like.

In exemplary embodiments, the escalating means 108 may comprise a hand crank and/or lever. The escalating means 108 may be turned or otherwise activated by the user. When the escalating means 108 is activated, the escalating member 106 may be raised and/or lowered, thereby raising and/or lowering the user. At the lowest position, one or more pins 128 may be engaged by one or more recessed portions 130 of the locking disc 126. As the user activates and/or turns the escalating means 108, which may be connected to a locking disc 126, the recessed portions 130 of the locking disc 126 may disengage from a pin 128 connected to the track 134. The track 134 may be integral with the legs of a ladder, or may comprise a separate member attached to the ladder.

As the user continues to turn and/or activate the escalating means 108, at least one of the edges 132 of the locking disc 126 may engage the top of an adjacent pin 128, enabling the user to continue to rotate the disc about the pin 128. As the user continues to turn and/or activate the escalating means 108, the disc 126 may continue to climb up the pins 128 and up the track 134, moving the user upward in the direction of x. Once the user reaches a desired location, the recessed portion 130 of the disc 126 engages onto a pin 128 of the track 134, and the escalating member 106 may be locked in place at an escalated position. The engagement of a recessed portion 130 onto a pin 128 is automatic upon engaging the escalating means 108. In alternative embodiments, an additional locking means, such as a clamp, a break, a slide lock, or the like, may be included and adapted to resist and/or prevent the disc 126 from retracting or otherwise sliding downward and/or upward on the track 134 while locked into position.

FIG. 3A-3D depicts a set of views of the positioning of a locking disc 126 in a descending position, in the direction of arrow y, for use with the embodiments of the stepless ladder. Similar to the ascending methods, upon initial descent, the user may disengage the pin 128 on which the recessed portion 130 of the locking disc 126 is resting. The user may disengage the pin 128 by activating the escalating means 108 and/or pulling the escalating means 108 in a direction away from the pin 128, such that the recessed portion 130 of the disc 126 is moved away from the pin 128 and the disc 126 is allowed to move along the track 134. In some embodiments, when the disc 126 is disengaged from the pin 128, the user may crank and/or ratchet down or otherwise activate the escalating means 108 until the escalating member 108 is in a desired position, e.g., the bottom.

As the user continues to turn and/or activate the escalating means 108, at least one of the edges 132 of the locking disc 126 may engage the top of an adjacent pin 128, enabling the user to continue to rotate the disc about the pin 128. As the user continues to turn and/or activate the escalating means 108, the disc 126 may continue to descend down the pins 128 and down the track 134, moving the user downward in the direction of y. Once the user reaches a desired location, the user may engage the recessed portion 130 of the disc onto a pin 128 of the track 134, and the escalating member 106 may be locked in place. When the escalating means 108 is at and/or near the bottom of the frame, the user may be able to step off or otherwise leave the ladder.

In many embodiments, safety mechanisms may be provided on the escalating means 108 to prevent a user from crashing down while trying to operate the mechanism. In one embodiment, the locking discs 126 may be designed to never pass more than one pin 128 unless the user is actively engaging the escalating means 108, lever, or crank mechanism (or other mechanism described herein). In a further embodiment, hydraulic shocks may be embedded within the frame 102 in efforts to slow the descent of any free-falling escalating member 106.

Figure 4A:
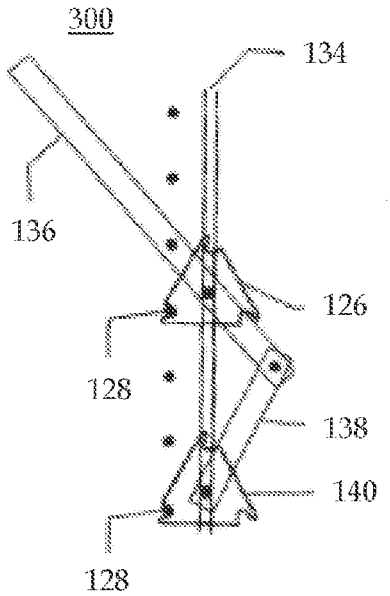
FIGS. 4A-4C depict a view of the positioning of a locking disc in an escalating position for use with a stepless ladder in accordance with embodiments of the present invention.
Figure 4B:
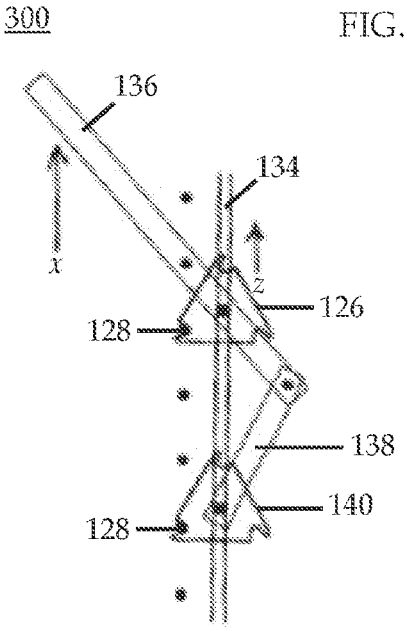
Figure 4C:
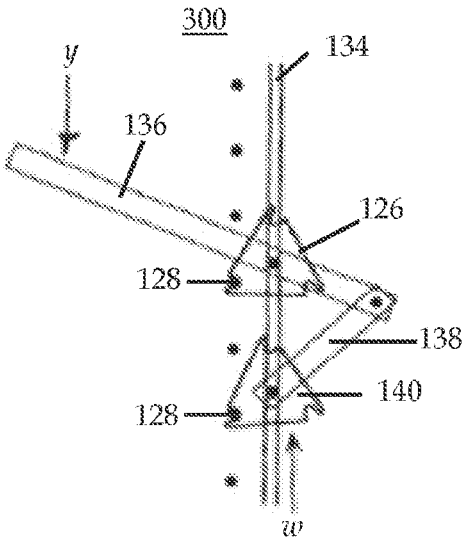
Figure 5A:
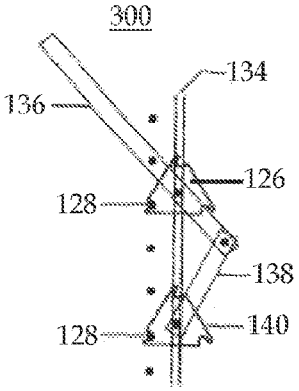
FIGS. 5A-5E depict a view of the positioning of a locking disc in an descending position for use with a stepless ladder in accordance with embodiments of the present invention.
Figure 5B:
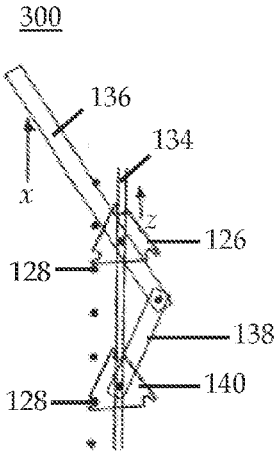
Figure 5C:
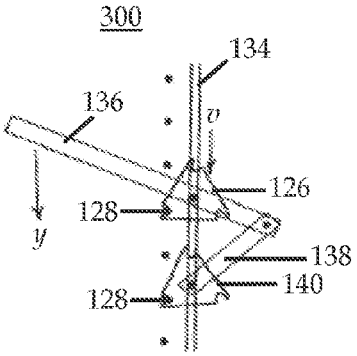
Figure 5D:
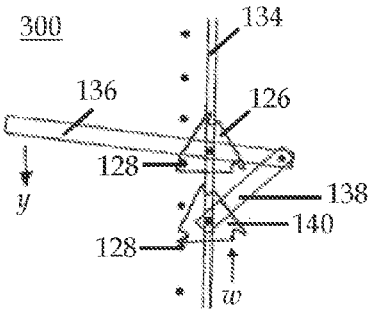
Figure 5E:
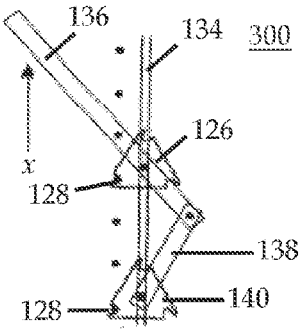

FIGS. 4A-4C depict a set of views of the positioning of a locking disc 126 in an escalating position for use with a stepless ladder in accordance with embodiments of the present invention. In some embodiments, an escalating means 108 may comprise a lever or lever 136 and a dual-cam or dual-locking disc structure. A lever 136 may be provided that may be attached to a first locking disc 126. A link member 138 may be attached and/or coupled with the lever 136 via a hinge and/or post on one end and attached and/or coupled with a second locking disc 140 on a second end. In such embodiment, a first disc 126 may be positioned adjacent to or attached to the lever 136, and a second disc 140 may be positioned adjacent to or attached to the end of the link member 138. Although two discs 126, 140 are displayed in the Figures, embodiments of the present invention may include additional discs 126, for example, three, six, ten discs, or the like.

As shown in FIGS. 4A-4C, the locking discs 126, 140 may operate in a similar way to the locking disc 126 of FIGS. 2A-2D and 3A-3D. Initially, when escalating, the user may lift the lever 136 in the direction of arrow x and cause the first locking disc 126 move upwardly in the direction of arrow z and lock on a higher pin 128. The user may then pull down the lever 136 in the direction of arrow y and cause the first locking disc 126 to rotate and lock on a pin 128, thereby pulling up the second locking disc 140 in the direction of arrow w to a higher pin. The user may repeat this process until the user reaches a desired position.

FIG. 5 depicts a set of views of the positioning of pair of locking discs 126, 140 in a descending position for use with the embodiment of the stepless ladder shown in FIG. 4. Inverse to escalating, to descend, the user may push up on the lever in the direction of arrow x and disengage the first locking disc 126 so that the first locking disc 126 moves upwardly in the direction of arrow z and disengages form the pin 128. The user may then push down on the lever 136 in the direction of arrow y to move the first locking disc 126 downwardly and/or allow gravity to push down the escalating member 106 until the first locking disc 126 is engaged and/or coupled with a lower pin 128 beneath its original position. As the first disc 126 engages the pin 128 beneath its original position, the user may then unlock the second disc 140. The user may unlock the second disc 140 by pushing down on the lever 136 in the direction of arrow y while the first disc is engaged with the pin 128, thereby moving the second disc 140 upwardly in the direction of arrow w, away from a pin 128. The user may then push up on the lever 136 in the direction of arrow x and allow the second disc 140 to decend downwardly and engage with a pin 128 lower than its original position. As the first disc 126 and/or second disc 140 move downwardly, the escalating member and the user may be lowered as well. The user may continue to repeat these steps until a desired position is reached.

In additional embodiments, an escalating means 108 may also comprise any electrical, mechanical, hydraulic or similar apparatus for raising and lowering the escalating member. In further embodiments, the stepless ladder 100 may comprise a tool platform which may be connected to the escalating member 106 or may have its own escalating means. As such, a user need not worry about carrying tools while engaging the escalating means 108.

Figure 6:
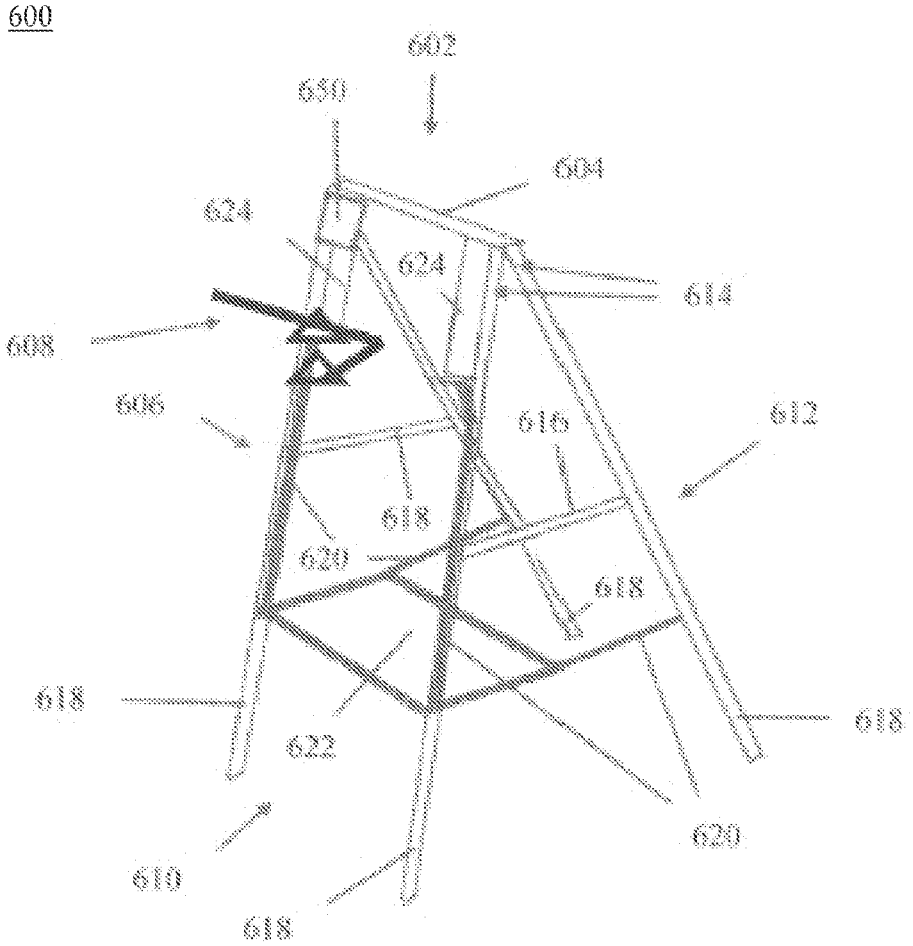
FIG. 6 depicts a perspective view of a stepless ladder assembly in accordance with embodiments of the present invention.

FIG. 6 depicts a perspective view of a stepless ladder assembly 600 in accordance with embodiments of the present invention. In exemplary embodiments, the stepless ladder assembly 600 may generally comprise components described hereinabove. The stepless ladder 600 may comprise a frame 602, a top shelf 604, an escalating member 606, an escalating means 608, a front portion 610, a rear portion 612, a bar 616, one or more legs 618, one or more attachment arms 620, a platform 622, and cover 624 that may be generally similar to the corresponding elements described hereinabove. In some embodiments, the ladder 600 may also comprise a power source 650. One or more support arms 620 may also be connected to the rear portion 612 of the ladder 600. The power source 650 may be adapted to supply sufficient power to an electrical lifting mechanism to raise and/or lower the platform 622 when activated. The power source 650 may comprise a battery that may be rechargeable, via an electrical outlet or an alternative energy source, such as solar power. The power source 650 may also comprise an electrical connection, such as a power cord, adapted to connect with a power outlet and supplying power to the ladder 600. The ladder 600 may also comprise an activation means, for example, a button, a switch, or a remote control that may be used to activate the escalating means 606 and supply power to the escalating means 606.

In some embodiments, when a power supply 650 is included, the escalating means 606 may be adapted to raise and lower the platform via electrical power. One or more of the arms 620 may be coupled with a track on the rear portion 612 of the ladder 600 and attached to the platform 622 via a hinge, or the like. In some embodiments, one or more of the arms 620 may be telescoping and/or include hydraulics. When the platform is raised 622 the one or more of the arms 620 may be adapted to hinge downwardly allowing the platform 622 to move upward in a substantially level configuration. When the platform 622 has reached a position desired by the user, the one or more arms 620 may also be locked into a position along a track, so that the one or more arms 620 may be prevented from sliding or otherwise moving downwardly. When the user desires to move back down the ladder 600, the escalating means 608 may be activated such that the process is reversed and the platform 622 moves downwardly toward the bottom of the ladder 600.

Figure 7:
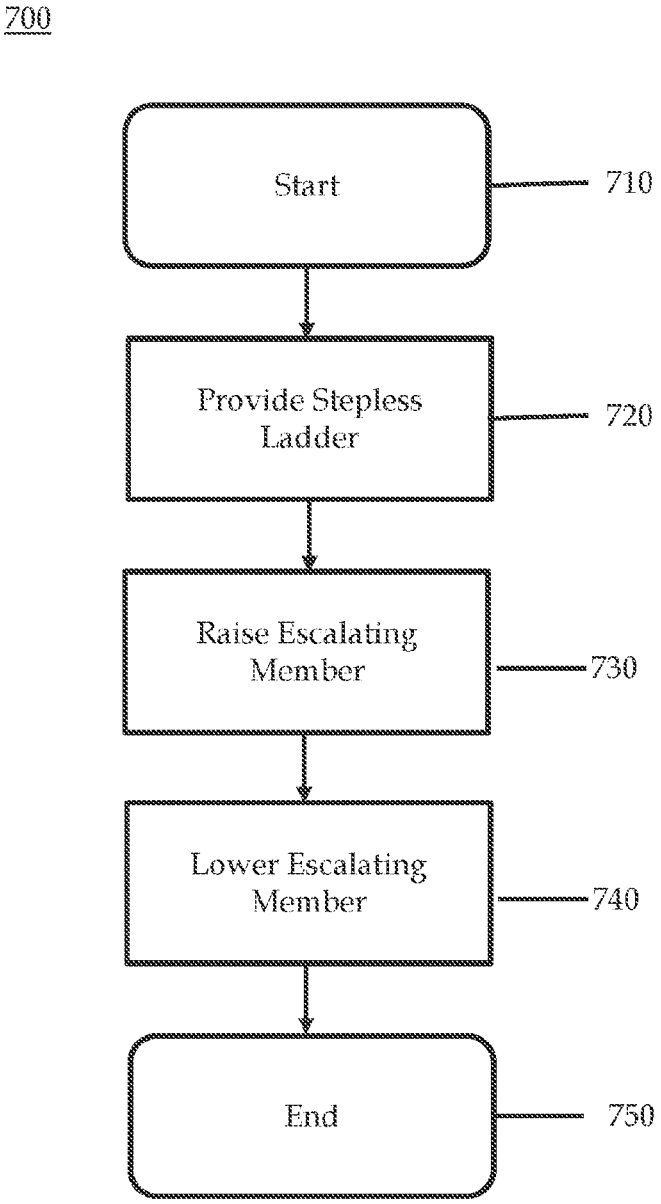
FIG. 7 depicts a method of using a stepless ladder assembly in accordance with embodiments of the present invention.

FIG. 7 depicts an exemplary method 700 of using a stepless ladder assembly in accordance with embodiments of the present invention. The method 700 begins at step 710. For ease, the methods described herein may refer to the stepless ladder 100 described in FIGS. 1-3D. At step 720 a stepless ladder 100 in accordance with embodiments of the present invention is provided. At step 730 a user may stand or otherwise be supported on the platform 122 of the escalating member 106 and the escalating means 108 may be activated. The escalating means 108 may move the escalating member 106 to a position chosen by the user. In some embodiments, the escalating means 108 may be adapted to move and/or lock the escalating member 106 into any position along the height of the ladder along the track 134. In alternative embodiments, the escalating means 108 may be adapted to move the escalating member 106 to predetermined fixed positions, for example, every 6 inches, every foot, every two feet, or the like.

When the escalating member 108 is activated, the escalating member 106 may be raised and/or lowered, thereby raising and/or lowering the user. At the lowest position, one or more pins 128 may be engaged by one or more recessed portions 130 of the locking disc 126. As the user activates and/or turns the escalating means 108, which may be connected to a locking disc 126, the recessed portions 130 of the locking disc 126 may disengage a pin 128 connected to the track 134. The track 134 may be integral with the legs of a ladder, or may comprise a separate member attached to the ladder.

As the user continues to turn and/or activate the escalating means 108, at least one of the edges 132 of the locking disc 126 may engage the top of an adjacent pin 128, enabling the user to continue to rotate the disc about the pin 128. As the user continues to turn and/or activate the escalating means 108, the disc 126 may continue to climb up the pins 128 and up the track 134, moving the user upward in the direction of x. Once the user reaches a desired location, the user may engage the recessed portion 130 of the disc onto a pin 128 of the track 134, and the escalating member 106 may be locked in place at an escalated position. In alternative embodiments, an additional locking means, such as a clamp, a break, a slide lock, or the like, may be included and adapted to resist and/or prevent the disc 126 from retracting or otherwise sliding downward and/or upward on the track 134 while locked into position.

At step 740, after the user is finished using the ladder 100, the user may choose to descend down the ladder 100 by lowering the escalating member 106. Similar to the ascending methods, upon initial descent, the user may disengage the pin 128 on which the recessed portion 130 of the locking disc 126 is resting. The user may disengage the pin 128 by activating the escalating means 108 and/or pulling the escalating means 108 in a direction away from the ladder, such that the recessed portion 130 of the disc 126 is moved away from the pin 128 and allowed to move along the track 134. In some embodiments, when the disc 126 is disengaged from the pin 128, the user may crank down, ratchet down, or otherwise activate the escalating means 108 until the escalating member 108 is in a desired position, e.g., the bottom.

As the user continues to turn and/or activate the escalating means 108, at least one of the edges 132 of the locking disc 126 may engage the top of an adjacent pin 128, enabling the user to continue to rotate the disc about the pin 128. As the user continues to turn and/or activate the escalating means 108, the disc 126 may continue to descend down the pins 128 and up the track 134, moving the user downward. Once the user reaches a desired location, the user may engage the recessed portion 130 of the disc onto a pin 128 of the track 134, and the escalating member 106 may be locked in place. When the escalating member 106 is at and/or near the bottom of the frame, the user may be able to step off or otherwise leave the ladder. After the user is lowered to a desired position, the method may end at step 750.

Figure 8:
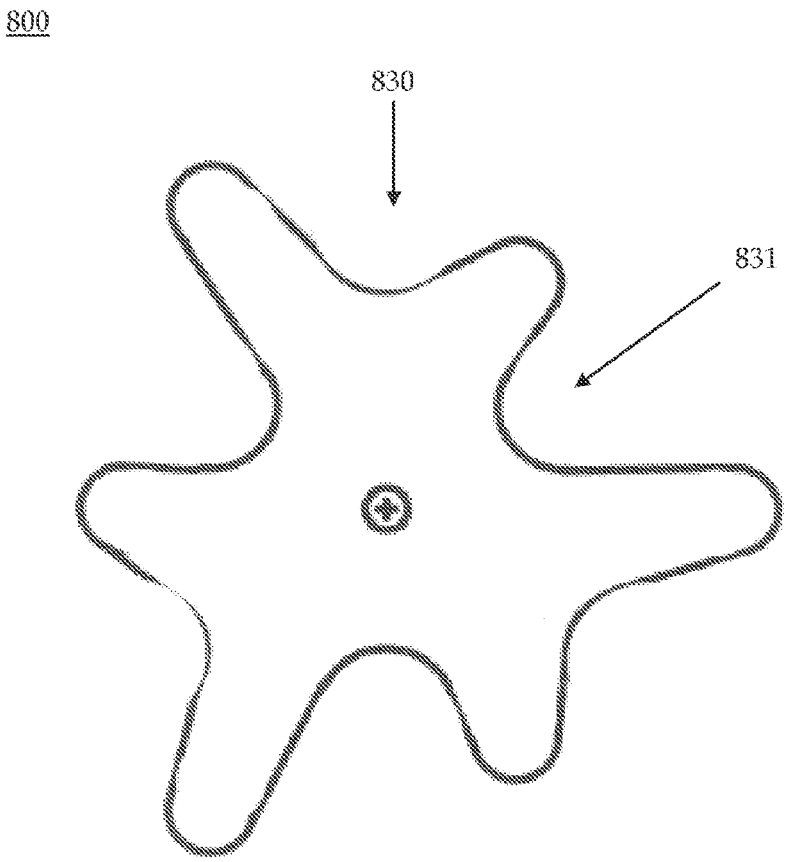
FIG. 8 depicts a side view of an exemplary locking disc in accordance with embodiments of the present invention.

FIG. 8 depicts a side view of an exemplary locking disc 800 in accordance with embodiments of the present invention. A locking disc 800 may be used with a lifting mechanism consistent with the present disclosure. Although locking discs comprising uniform recessed portions are generally depicted in FIGS. 1-6, a locking disc 800 may comprise one or more recessed portions 830, 831 having different shapes and/or sizes. For example, a locking disc 800 may comprise an outer recessed portion or notch 830 and an inner recessed portion or notch 831. The outer recessed portion 830 and the inner recessed portion 831 may be shaped differently and may allow the lifting mechanism to be activated and/or lifted with less force applied to a lever, such as an exemplary lever described with respect to FIGS. 1-6. An outer recessed portion 830 and inner recessed portion 831 having different shapes and/or sizes may also be adapted to promote a smoother transition of a connected platform, or the like, from a lower position to a higher position on a track, or from a higher position to a lower position on a track. The locking disc 800 may be included in any embodiment described herein, including the embodiments described with respect to FIGS. 1-7. In some embodiments, the locking disc 800 may comprise the shape of a three lobbed cam, or the like. Alternative shapes may be used and are contemplated within embodiments of the present disclosure.

While the foregoing is directed to embodiments of the present invention, other and further embodiments of the invention may be devised without departing from the basic scope thereof. It is also understood that various embodiments described herein may be utilized in combination with any other embodiment described, without departing from the scope contained herein.

What is claimed is:

1. A ladder assembly comprising:
- a frame adapted to support the weight of a user;
- a track attached to a portion of the frame;
- a plurality of pins attached to a portion the frame;
- an escalating member attached to the track, the escalating member for supporting the weight of the user;
- a lever having a first end and a second end;
- an escalating means that travels up and down the track, wherein the direction of travel is determined solely by the range-of-motion imparted to the lever, the escalating means comprising:
  - a first locking disc coupled to the lever at the center of the disc in an area of the lever between the first end and the second end of the lever, the first locking disc coupled with the lever with a first central axle, the first locking disc rotatable about the first central axle, the first locking disc comprising a first plurality of recessed portions adapted to engage the plurality of pins;
  - a link member having a first end and a second end, the link member hinged to the lever at an area on the first end of the link member and at an area on the second end of the lever via a post;
  - a second locking disc coupled to the link member at the center of the second locking disc at a point on the second end of the link member with a second central axle, the second locking disc positioned lower on the frame than the first locking disc, the second locking disc rotatable about the second central axle, the second locking disc comprising a second plurality of recessed portions adapted to engage the plurality of pins.

2. The ladder assembly of claim 1, wherein the escalating member comprises at least one of a platform, a bucket, and a set of single-foot platforms.

3. The ladder assembly of claim 1, wherein the frame is collapsible.

4. The ladder assembly of claim 1, wherein the frame comprises:
- a front portion having the escalating means and escalating member disposed thereon; and
- a rear portion for balancing the ladder assembly.

5. The ladder assembly of claim 1, wherein the frame comprises two or more legs for supporting the weight of the user.

6. The ladder assembly of claim 1, wherein the escalating member comprises one or more attachment arms adapted to attach the escalating member to the frame, the attachment arms disposed on one or more corners of the escalating member.

7. The ladder assembly of claim 6, wherein the one or more attachment arms comprise at least one of a rod, a post, a strap, a rope, a beam, and a chain.

8. The ladder assembly of claim 1, further comprising safety guards adapted to cover the escalating means.

9. The ladder assembly of claim 1, wherein lifting the lever up a predetermined distance and lowering the lever back down at least the predetermined distance causes the first locking disc to rotate about the first central axle, thereby causing a first recessed portion of the plurality of recessed portions to disengage from a first pin of the plurality of pins and a second recessed portion of the first plurality of recessed portions to substantially simultaneously engage a second pin of the plurality of pins, wherein the second pin is disposed at a position higher on the frame than the first pin, thereby raising the escalating member; and wherein lifting the lever up at a distance greater than the predetermined distance and lowering the lever back down at least the distance greater than the predetermined distance causes the first locking disc to disengage from the plurality of pins, wherein a weight of the escalating member forces the first rotating disc to rotate about the first central axle, thereby causing the first recessed portion of the first plurality of recessed portions to disengage from the first pin of the plurality of pins and a third recessed portion of the first plurality of recessed portions to engage a third pin of the plurality of pins, wherein the third pin is disposed at a position lower on the frame than the first pin, and thereby lowering the escalating member.

10. The ladder assembly of claim 1, wherein lifting the lever up a predetermined distance and lowering the lever back down at least the predetermined distance raises the escalating member; and wherein lifting the lever up at a distance greater than the predetermined distance and lowering the lever back down at least the distance greater than the predetermined distance lowers the escalating member.

11. A ladder assembly comprising:

a frame adapted to support the weight of a user;

a track attached to a portion of the frame;

an escalating member attached to the track, the escalating member for supporting the weight of the user;

a handle having a first end and a second end;

an escalating means that travels up and down the track using only action of the handle, wherein the direction of travel is determined solely by the range-of-motion imparted to the handle, the escalating means comprising:

a first locking disc comprising an edge and a recessed portion, the first locking disc attached to the handle at the center of the first locking disk at a point between the first end and the second end of the handle with a first central axle, the first locking disc rotatable about the first central axle;

a second locking disc comprising an edge and a recessed portion;

a link member having a first end and a second end, the link member connected to the second locking disc at the center of the second locking disc at the first end of the link member and pivotally connected to the handle at the second end of the handle and at the second end of the link member, the second locking disc positioned lower on the frame than the first locking disc, the second locking disc rotatable about a second central axle;

a first pin attached to the track, the pin adapted to support the first locking disc; and a second pin attached to the track, the second pin adapted to support the second locking disc; and wherein a range-of-motion imparted to the handle determines a direction of travel without the need for a secondary control mechanism.

12. The ladder assembly of claim 11, wherein when the handle is pulled downwardly and the first locking disc is engaged with a pin, the first locking disc rotates around the higher pin, thereby moving the link member and disengaging the second locking disc from the second pin wherein the second locking disc may be raised up and engaged with a second higher pin.

13. The ladder assembly of claim 11, wherein the escalating member comprises at least one of a platform, a bucket, and a set of single-foot platforms.

14. The ladder assembly of claim 11, wherein the frame is collapsible.

15. The ladder assembly of claim 11, wherein the frame comprises:

a front portion having the escalating means and escalating member disposed thereon; and a rear portion for balancing the ladder assembly.

16. The ladder assembly of claim 11, wherein the frame comprises two or more legs for supporting the weight of the user.

17. The ladder assembly of claim 11, wherein lifting the handle up a predetermined distance and lowering the handle back down at least the predetermined distance causes the first locking disc to rotate about the first central axle, thereby causing a first recessed portion of the plurality of recessed portions to disengage from a first pin of the plurality of pins and a second recessed portion of the first plurality of recessed portions to substantially simultaneously engage a second pin of the plurality of pins, wherein the second pin is disposed at a position higher on the frame than the first pin, thereby raising the escalating member; and wherein lifting the handle at a distance greater than the predetermined distance and lowering the handle back down at least the distance greater than the predetermined distance causes the first locking disc to disengage from the plurality of pins, wherein a weight of the escalating member forces the first rotating disc to rotate about the first central axle, thereby causing the first recessed portion of the first plurality of recessed portions to disengage from the first pin of the plurality of pins and a third recessed portion of the first plurality of recessed portions to engage a third pin of the plurality of pins, wherein the third pin is disposed at a position lower on the frame than the first pin, and thereby lowering the escalating member.

18. The ladder assembly of claim 11, wherein lifting the handle up a predetermined distance and lowering the handle back down at least the predetermined distance raises the escalating member; and wherein lifting the handle at a distance greater than the predetermined distance and lowering the handle back down at least the distance greater than the predetermined distance lowers the escalating member.

19. A lifting mechanism for lifting an object, the lifting mechanism comprising:

an escalating member attached to a track, the escalating member for supporting the weight of the object;

an elongated lever having a first end and a second end;

an escalating means that travels up and down the track using only action of the lever, wherein the direction of travel is determined solely by the range-of-motion imparted to the lever, the escalating means comprising:

a first locking disc coupled to the lever at the center of the first locking disc in an area of the lever between the first end and the second end of the lever, the first locking disc coupled with the lever with a first central axle, the first locking disc rotatable about the first central axle, the first locking disc comprising a first plurality of recessed portions adapted to engage the plurality of pins;

a second locking disc positioned lower on the frame than the first locking disc, the second locking disc rotatable about a second central axle, the second locking disc comprising a second plurality of recessed portions adapted to engage the plurality of pins;

a link member having a first end and a second end, the link member connected at the second end to the second locking disc via the central axle and hinged to the lever at an area on the first end of the link member and at an area on the second end of the lever;

a first pin attached to the track, the pin adapted to support the first locking disc; and a second pin attached to the track, the second pin adapted to support the second locking disc;

wherein a range-of-motion imparted to the lever determines a direction of travel without the need for a secondary control mechanism.

* * * * *